US005497915A

United States Patent [19]

Wass

[11] Patent Number: 5,497,915

[45] Date of Patent: Mar. 12, 1996

[54] DISPENSER PUMPS

[75] Inventor: Anthony Wass, Lincolnshire, Great Britain

[73] Assignee: The English Glass Company Limited, Leicester, Great Britain

[21] Appl. No.: 196,137

[22] PCT Filed: Aug. 14, 1992

[86] PCT No.: PCT/GB92/01504

§ 371 Date: Jun. 28, 1994

§ 102(e) Date: Jun. 28, 1994

[87] PCT Pub. No.: WO93/03857

PCT Pub. Date: Mar. 4, 1993

[30] Foreign Application Priority Data

Aug. 16, 1991 [GB] United Kingdom ..... 9117717

[51] Int. Cl.[6] ..... B67D 5/00

[52] U.S. Cl. ..... 222/153.07; 222/153.13; 222/383.1; 222/384; 222/385

[58] Field of Search ..... 222/153, 309, 222/383, 385, 321, 153.07, 153.13, 321.1, 321.7, 321.9, 383.1, 384

[56] References Cited

U.S. PATENT DOCUMENTS

| | | | |
|---|---|---|---|
| 2,069,076 | 1/1937 | Majewski . | |
| 4,377,106 | 5/1983 | Workman et al. | 222/153 X |
| 4,424,919 | 1/1984 | Knox et al. | 222/153 |
| 4,479,589 | 10/1984 | Ford . | |
| 4,496,085 | 1/1985 | Ford et al. . | |
| 4,515,298 | 5/1985 | Czech . | |
| 4,524,888 | 6/1985 | Tada . | |
| 4,566,611 | 1/1986 | Sukopp | 222/153 |
| 4,589,574 | 5/1986 | Foster | 222/153 |
| 4,746,035 | 5/1988 | Anderson et al. | 222/153 |
| 4,867,347 | 9/1989 | Wass et al. | 222/153 |
| 4,871,092 | 10/1989 | Maerte | 222/153 |
| 4,872,596 | 10/1989 | Corsette . | |
| 5,255,823 | 10/1993 | Tichy et al. | 222/153 |

FOREIGN PATENT DOCUMENTS

| | | |
|---|---|---|
| 0401965A3 | 12/1990 | European Pat. Off. . |
| 1348560 | 3/1974 | United Kingdom . |

*Primary Examiner*—Kevin P. Shaver

*Attorney, Agent, or Firm*—Fay, Sharpe, Beall, Fagan, Minnich & McKee

[57] ABSTRACT

A dispenser pump, for fitting to a container neck to dispense liquids in small doses, has a pump body (39) with a fixed discharge nozzle (25) and a reciprocable plunger to pump liquid through a valved inlet (41) of a pump chamber (38) and out through the discharge nozzle. To enable the pump body (39) to be recessed into the container neck, the discharge nozzle (25) near the top of the pump chamber and the outlet near the bottom of the pump chamber are connected by a discharge channel (48) extending up through the pump body alongside the pump chamber (38). A tamper evident locking closure holds the plunger (70) in a particular rotational orientation in which it is locked down. Breaking and removing the tamper evident element simultaneously turns the plunger (70) to free it to rise.

20 Claims, 8 Drawing Sheets

DISPENSER PUMPS

FIELD OF THE INVENTION

This invention relates to dispenser pumps of the type in which dispensing is by a plunger action which displaces a piston relative to a cylinder in the pump, to expel material from a pump chamber through a discharge outlet, material for subsequent dispensing strokes being brought up into the pump chamber from a container through an inlet valve. Such pumps are commonly used for dispensing liquids and semi-liquids such as toiletries, lotions, liquid soaps and pharmaceutical products.

BACKGROUND OF THE INVENTION

The conventional use is for dispensing in small doses, e.g. a few ml. The containers and pumps are usually of plastics material. The pump is a module with a dip tube, and is screwed onto the container outlet neck. The discharge nozzle is usually integral with the top of the plunger, with the outlet passage and valve provided through the plunger above an inlet valve, at the bottom of the pump body.

This construction has proved simple and reliable. However, it does have some problems.

Firstly, the movement of the nozzle during dispensing can be a nuisance if accurate dispensing is wanted.

Secondly, there are problems in locking of the plunger for transport. The plunger may be locked in the "up" position, by a tall collar which fits around it to prevent depression. See e.g. U.S. Pat. No. 4,479,589. The projecting plunger takes up a lot of space. If the plunger is locked in the "down" position, e.g. by a screw engagement of the plunger head with an opening in the pump body, this is more compact. However, the locking action requires the head to be depressed and turned at the same time, causing an undesirable dribble from the swinging nozzle.

SUMMARY OF THE INVENTION

In a first aspect, we use a pump in which the discharge nozzle is axially fast with the body of the pump, usually at or towards a first axial end of the pump body from which the plunger projects. The second axial end of the pump body, with the inlet to the pump chamber, projects axially into the container outlet.

According to this first aspect, a discharge passage communicating between the pump chamber outlet and the discharge nozzle is defined within the pump body to extend axially alongside the pump chamber. Thus, the outlet from the pump chamber can be within the confines of the container neck, to reduce the axial height of the pump body above the container. In a piston and cylinder pump, the pump chamber outlet will most conveniently also be situated at the second end of the pump chamber, communicating to a discharge nozzle positioned outside the container neck opening with a substantial part of the pump body recessed into the container neck.

In particular, the extreme second (inner) end of the plunger may be disposed axially inside the container opening, relative to the end of the container neck, over a substantial proportion of its stroke length, desirably at least 30%, more preferably at least 45% and most preferably at least 60%. Where the pump has an end location for the container edge e.g. a radial wall part or a plug which projects radially from the body to define an end stop limiting insertion of the body into a container neck, a substantial proportion, desirably at least 30%, more preferably at least 45% and most preferably at least 60% of the axial stroke of the inner end of the plunger may lie axially towards the second end of the pump relative to this end location. This is achievable because the discharge passage may communicate from the pump chamber outlet axially past the axial end locator, within the pump body.

In a further preferred aspect, the inner end of the plunger is towards the second axial end of the pump, relative to the radially inner opening of the discharge nozzle, over at least 40%, more preferably 60% and most preferably at least 80% of the plunger stroke length.

The discharge passage preferably lies within the shape envelope of that portion of the pump body which projects down into the container, and which desirably has a cross-sectionally regular shape e.g. cylindrical.

The discharge passage may be defined between opposed surfaces of inner and outer pump body parts. For example, the pump body may have an outer shell within the container space, and an inner shell nested in the outer shell. The inner shell contains the pump chamber with its inner surface and with its outer surface defines, in co-operation with the inner surface of the outer shell, the discharge passage.

The discharge passage may include an elongate axially-extending recess or channel between the surfaces of these parts. It is preferred however that such a recess or channel be provided in only one of the parts, opposing a plain surface on the other, to avoid the need for a double alignment of parts in construction.

An air vent passage may likewise be defined between inner and outer parts of the pump body.

A further preferred aspect relates to the valve construction used in the pump. An inlet valve is preferably provided at the second end of the pump chamber. The outlet, leading to the discharge passage, is also desirably at the second (inner) end and preferably also has a valve. Most preferably the inlet and outlet openings for the pump chamber are provided close together, e.g. in axial register, and a single body has valve portions for both inlet and outlet. This valve body may have a central movable flap or plug for one valve and a radially outer flap for the other valve, e.g. in a disc shape. Usually the inlet is central and the outlet peripheral.

A further problem arising with plunger operated dispenser pumps is that of leakage during transport. Product must be stopped from reaching the discharge nozzle.

In a second independent aspect of this invention, we arrange for an axially locked transportation condition of the plunger—preferably the depressed condition—in which a part of the plunger engages a valve body in an inlet valve of the pump chamber to hold the valve shut. This may be by an axially-directed nose of the plunger engaging the valve body.

In this aspect, it is also preferred that the plunger have a vent-blocking part which, in the locked-down condition, blocks the exterior opening of an air vent passage of the pump. This prevents leakage from the vent, which communicates with the container interior past the pump chamber and may itself be formed with a narrow choke section to inhibit passage of liquids along it.

A further problem in this field of plunger-operated dispenser pumps is that of preventing unauthorized dispensing of product before purchase. It is well known to provide tamper-evident locks which prevent operation of the plunger until a sacrificial part is irreversibly broken.

In a further independent aspect of the present invention, a plunger-operated dispenser pump has a locked condition in which the plunger is held axially fixed and hence non-operable. A tamper-evident member is provided which engages both plunger and pump body so as to maintain the locked condition. The tamper-evident member can be removed only by breaking it open, gripping a manually engageable part thereof and using a predetermined opening movement. The tamper-evident member engages the plunger, or a relatively moveable part of the pump body involved in the lock, in such a way that the opening movement used to break it open also causes relative movement, preferably rotational, between the plunger and pump part to free the plunger.

In a preferred version, the plunger is locked down by retention of one or more detents thereon behind one or more detents of the pump body. It may then be unlocked by a relative rotation, preferably less than half a turn, between these components. The tamper-evident element engages one of the components—usually the plunger—circumferentially at a location radially spaced from the axis. When the tamper-evident element is pulled off, it rotates that component to disengage the detents. Preferably the plunger rises under the influence of a pump spring.

The preferred tamper-evident element is a ring around the plunger, having a frangible portion and a grippable tag portion. Preferably it engages the plunger at a location covered by the plunger head, so that the release mechanism is not apparent. The frangible portion and the means for engagement with the plunger head e.g. an upstanding projection, are preferably provided adjacent the tag.

Rotation prevention can be achieved by having the tamper-evident element engaging both the relatively rotatable components circumferentially, one of these engagements being released when the element is initially broken away.

The plunger may have a preferential rotational orientation relative to the pump body, assisting it to "find" the unlocked condition, e.g. by eccentricities of the plunger or of the pump body.

In any of the above aspects, the pump will usually be a module which is fittable onto a container neck after the container has been filled, with engagement of detent means on e.g. an outer securing collar of the pump with corresponding detent means on the container neck.

In a further aspect, the invention provides a container having at its outlet a dispenser pump according to any of the described aspects.

Embodiments of the invention are now described by way of example with reference to the accompanying drawings, in which:

FIG. 1(*b*) shows it fitted to a container;

Figure 1:
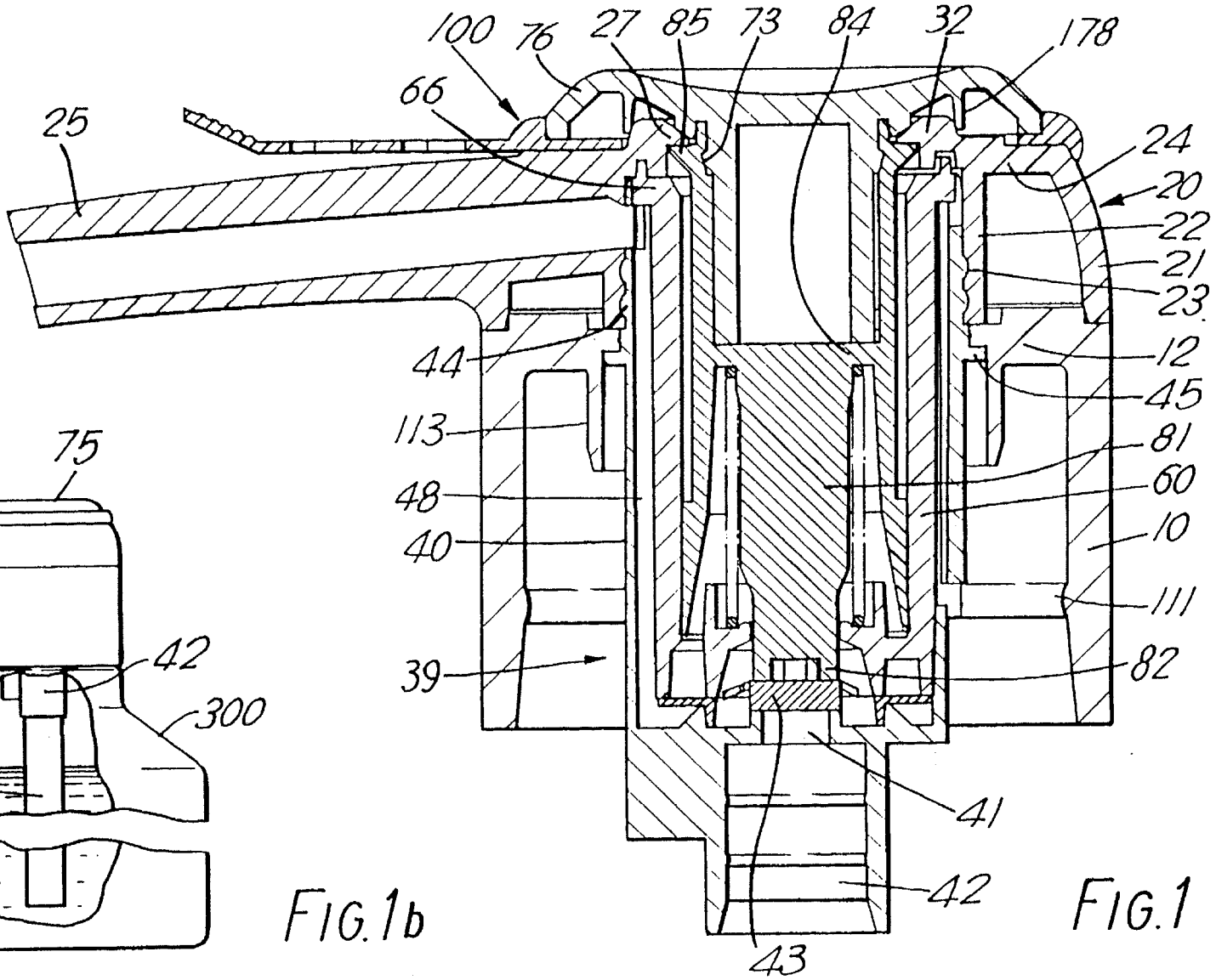
FIG. 1 is an axially-sectioned general arrangement showing a first embodiment of pump in a locked-down, tamper-evident condition.
Figure 1B:
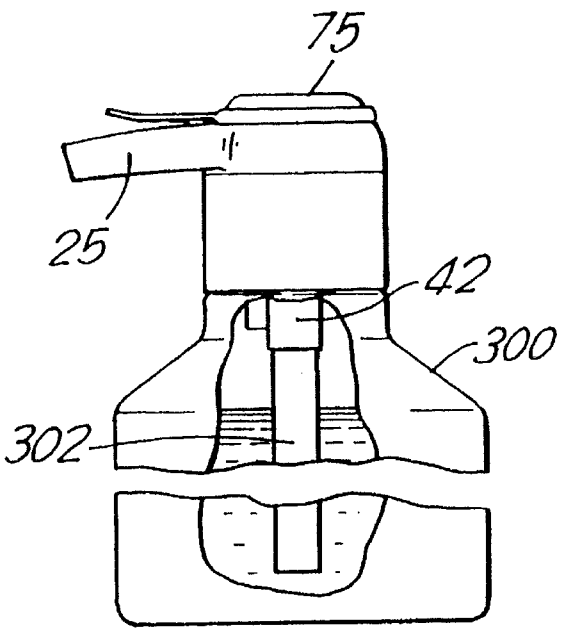
Figure 4:
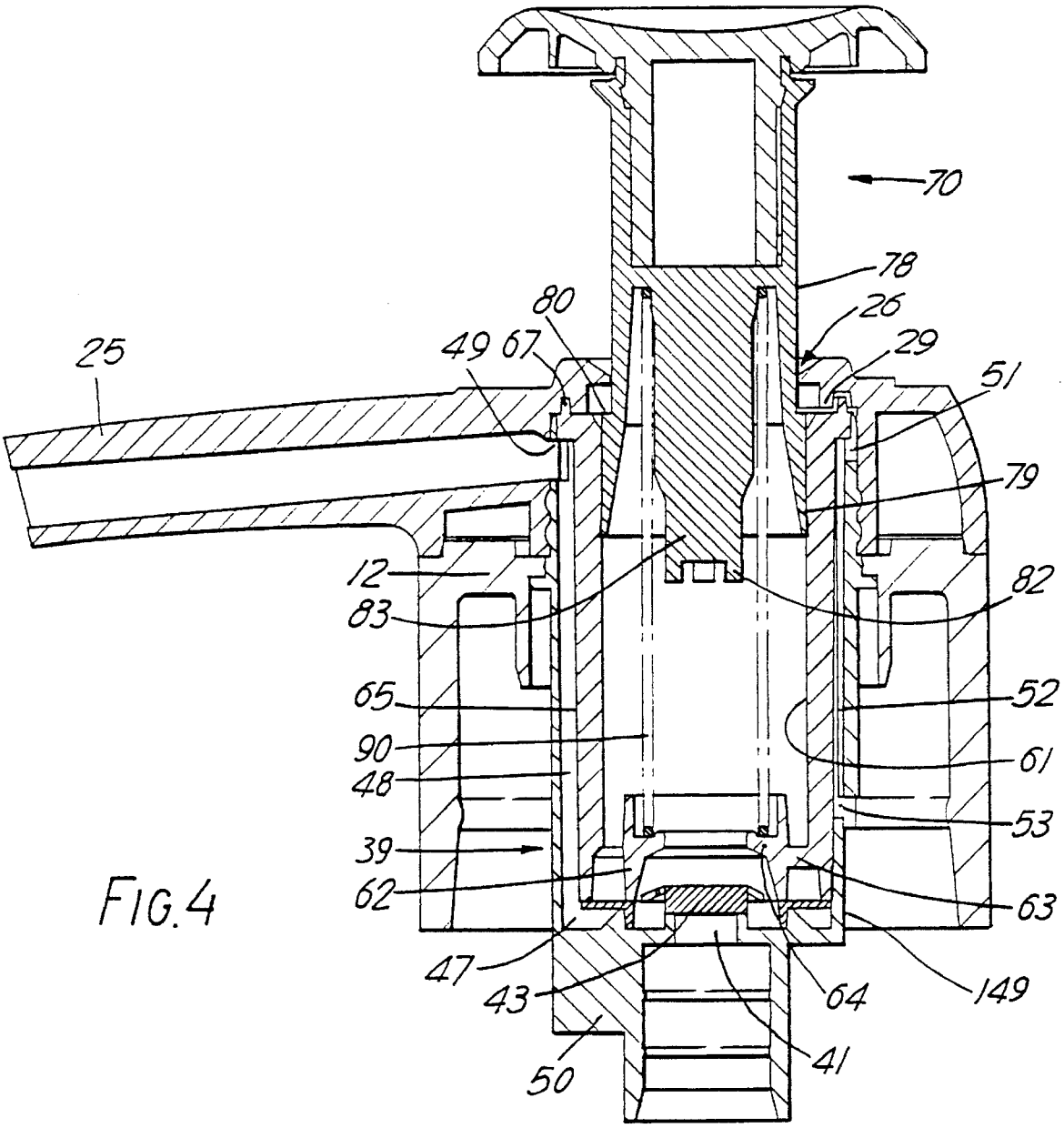
Figure 5:
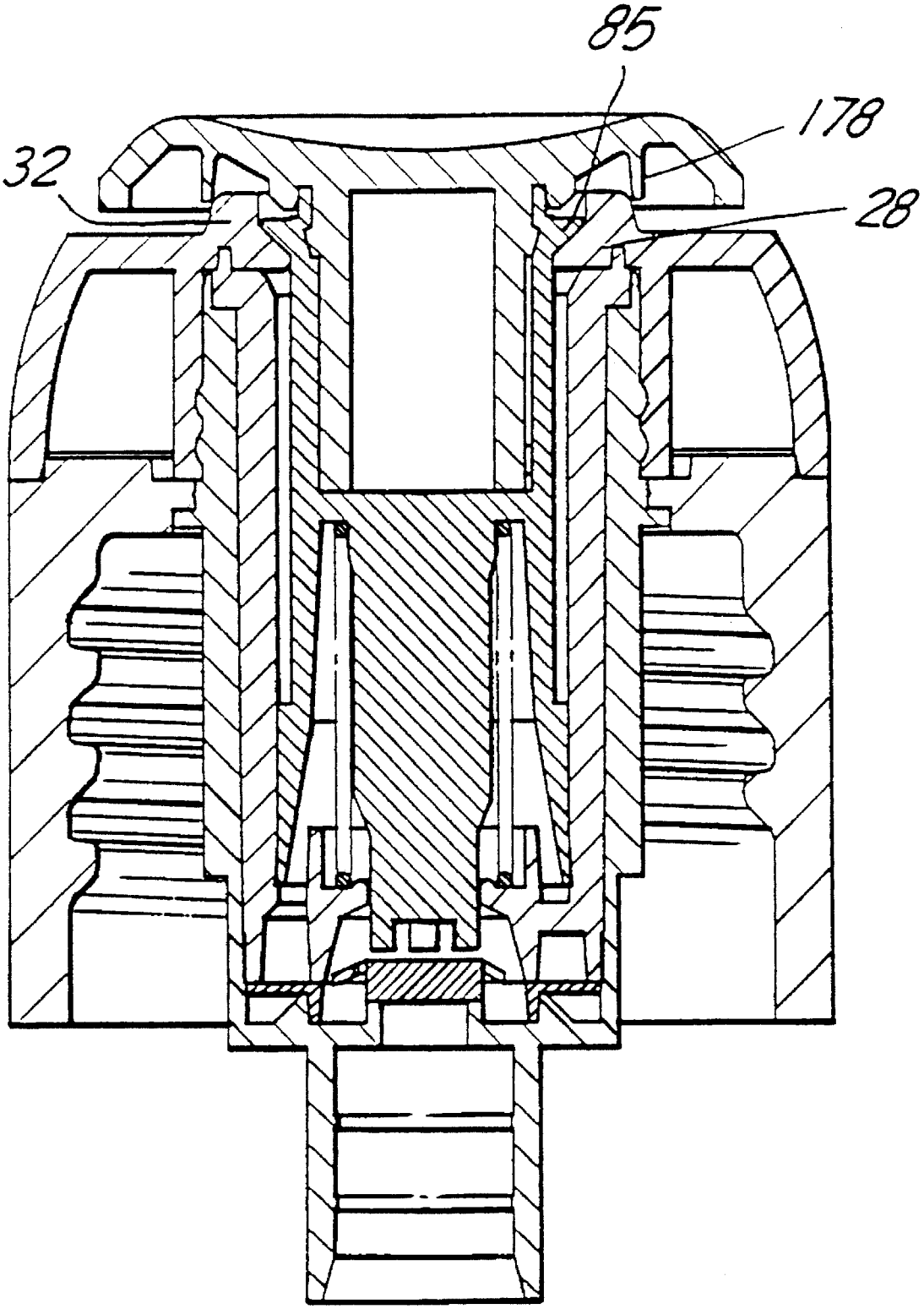
Figure 6:
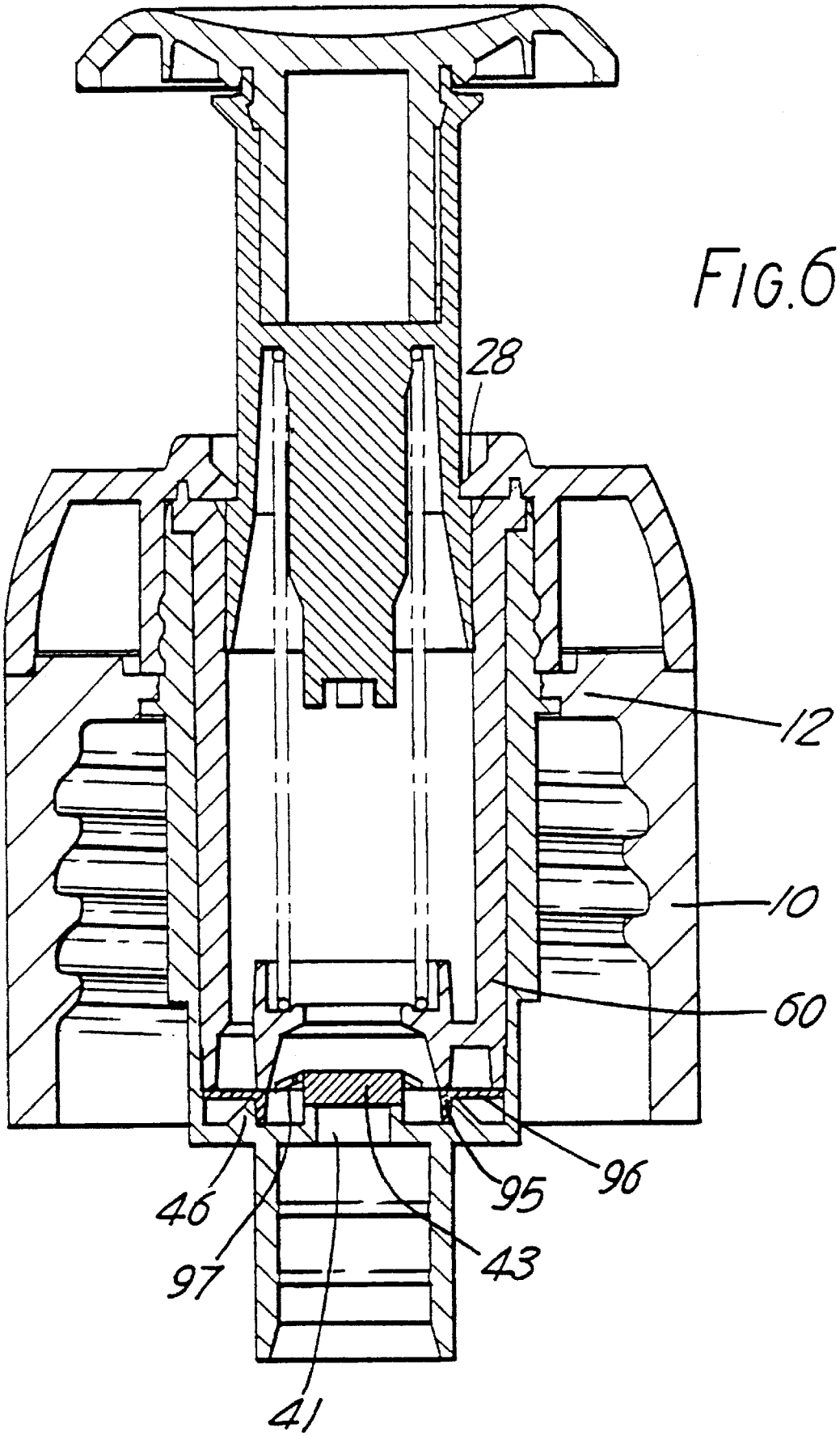
Figure 7:
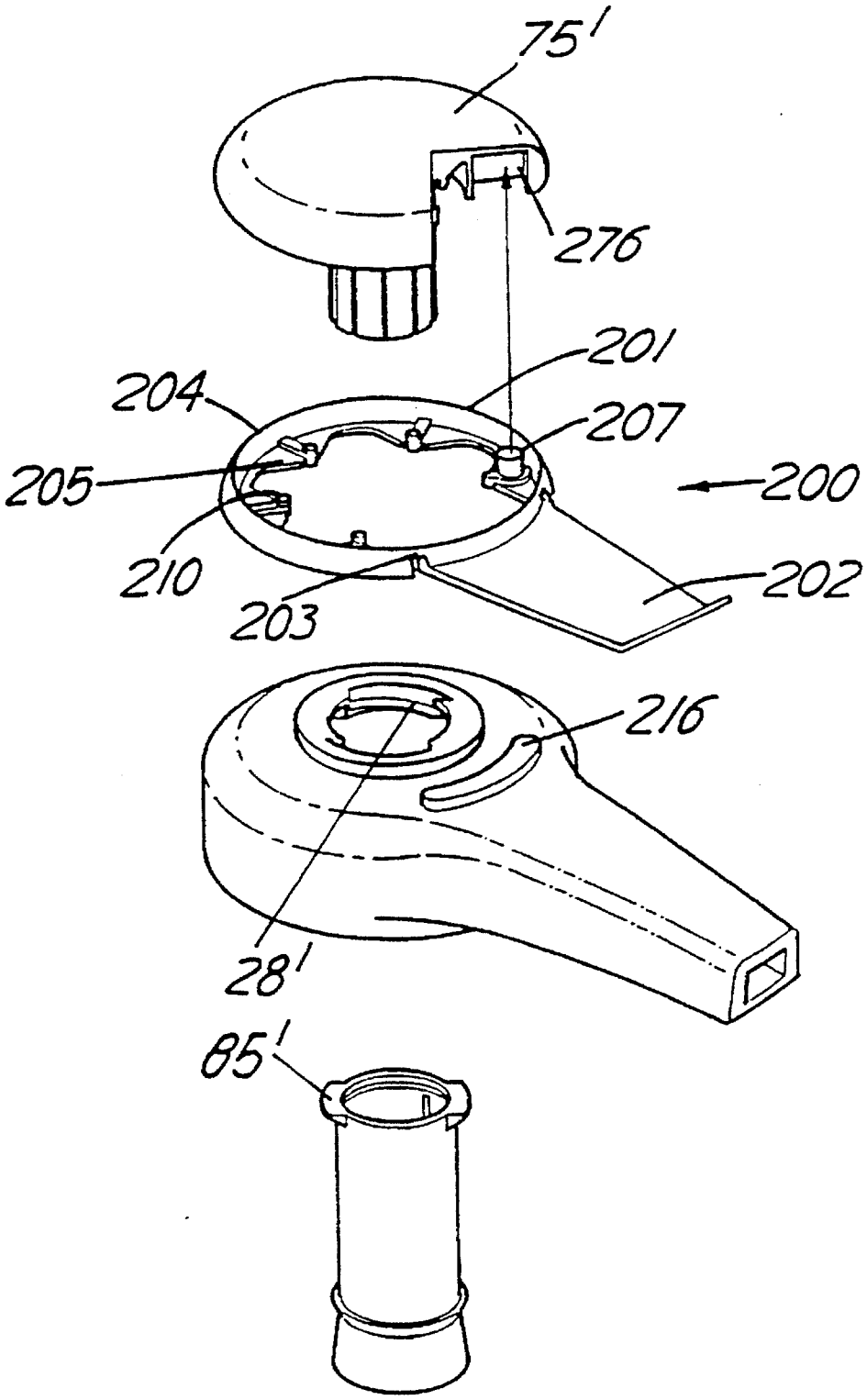

FIG. 3(*a*)–(*d*) show removal of the tamper-evident ring;

FIG. 4 is an axial section corresponding to FIG. 1 but with the plunger raised and the tamper-evident ring removed;

FIG. 5 is an axially-sectioned general arrangement of a screw-threaded embodiment, with the plunger down and tamper-evident ring removed, at right angles to the FIG. 1 view;

FIG. 6 shows the FIG. 5 view with the plunger up;

FIG. 7 shows a second form of tamper-evident ring assembly, and

Figure 8A:
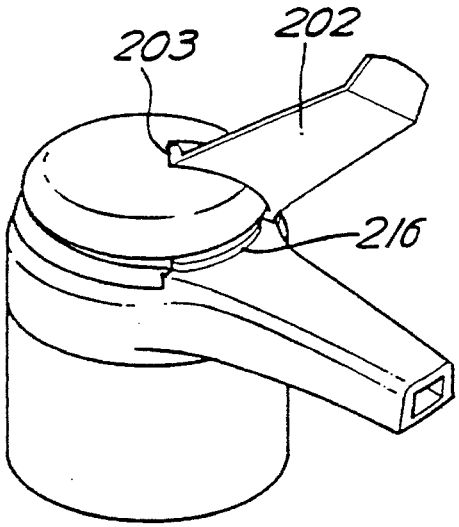
Figure 8B:
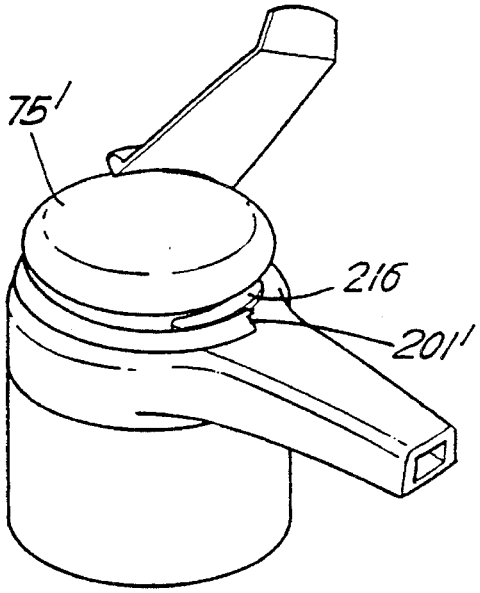

FIGS. 8(*a*),(*b*) and 9(*a*),(*b*) show modes of removal thereof.

DETAILED DESCRIPTION OF EMBODIMENTS

The general arrangement of parts is described with reference to FIGS. 1, 2 and 4 to 6. A dispenser pump for dispensing e.g. liquid soap in 1 ml doses comprises a cylindrical outer collar 10 with a smooth outer surface and an internal snap rib 111 for engaging a corresponding annular rib on the outside of a container neck. A generally cylindrical pump body 39 is positioned concentrically within the securing collar 10, fitting sealingly in a circular hole defined by an in-turned radial flange wall 12 around the top of the collar 10. Pump body 39 projects mostly below the flange wall 12. It has an outer cylindrical body shell 40 with a cylindrical insert shell 60 nested in it, with a smooth cylindrical inner surface 61 (FIG. 4) which forms a pump chamber 38.

The outer body shell 40 has a bottom wall with a central axial inlet opening 41 with a downwardly-opening cylindrical socket 42 for a conventional dip tube. Inlet opening 41 is governed by a plug valve 43.

FIG. 1(*b*) shows the pump mounted on a container 300, the neck of which snap fits into the pump. A dip tube 302 extends down from the socket 42 into the liquid for dispensing.

A body cap 20 comprising an integral discharge spout 25 has a down-turned outer cap wall 21 extending around the pump. A flat top wall portion 24 of the cap 20 has a central hole 26 for the stem 78 of a plunger 70. Depending from the top wall portion 24 radially inwardly of the outer wall 21 is a cylindrical securing skirt 22 which snaps over the projecting top of the body outer shell 40 by means of interfitting annular beads and grooves 44,23. Top flange 12 is thereby trapped between the body cap skirt 22 and a small radial flange 45 on the outer shell 40.

The pump parts are thereby axially secured, although the nozzle can be swivelled because flange 45 is recessed clear of the container neck.

A plunger 70 slides in the cylinder space in the insert shell 60. It has a head 71 with a press button 75, and a tubular stem 78 extending downwardly into the pump chamber 38. A helical spring 90 in the pump chamber urges the plunger upwardly, but in the FIG. 1 condition this is countered by a locking engagement of two diametrically opposed flanges 85 (see also FIG. 2) behind corresponding stop flange segments 27 which project in from opposing sides of the cap hole 26.

Figure 2:
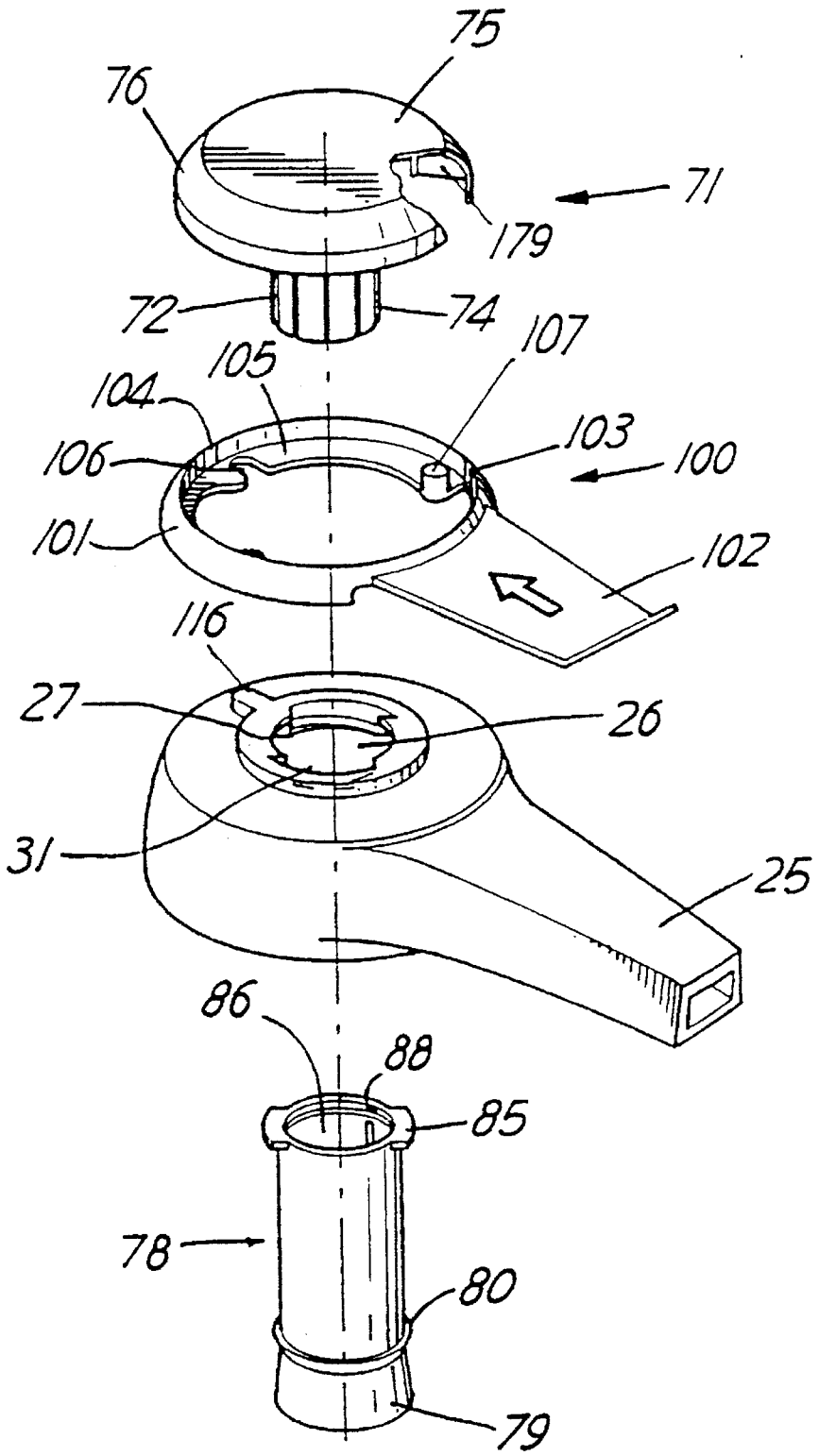
FIG. 2 shows in exploded perspective the assembly of a plunger and tamper-evident ring.
Figure 3A:
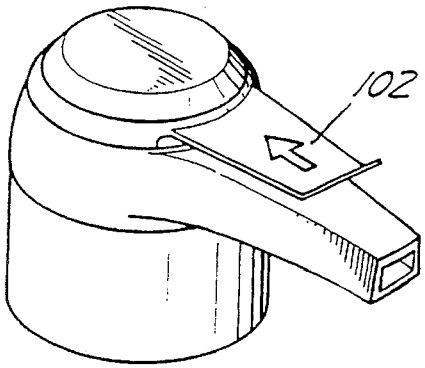
Figure 3B:
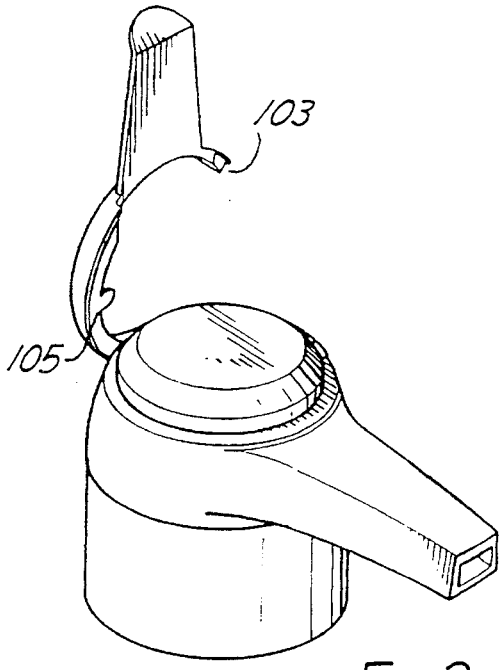
Figure 3C:
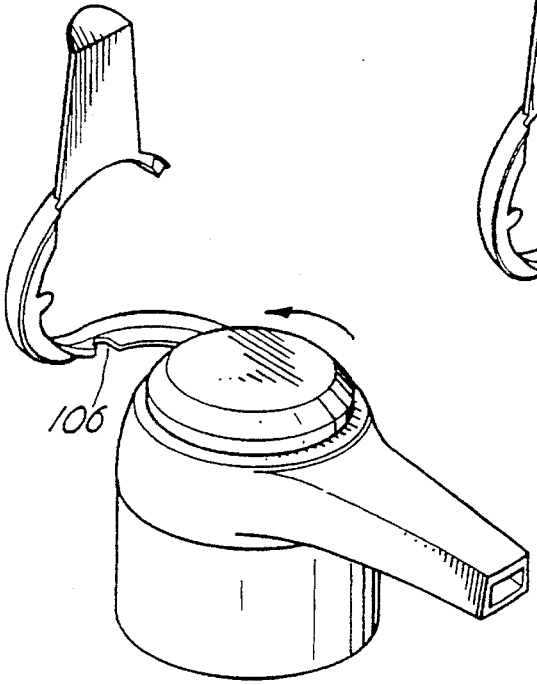
Figure 3D:
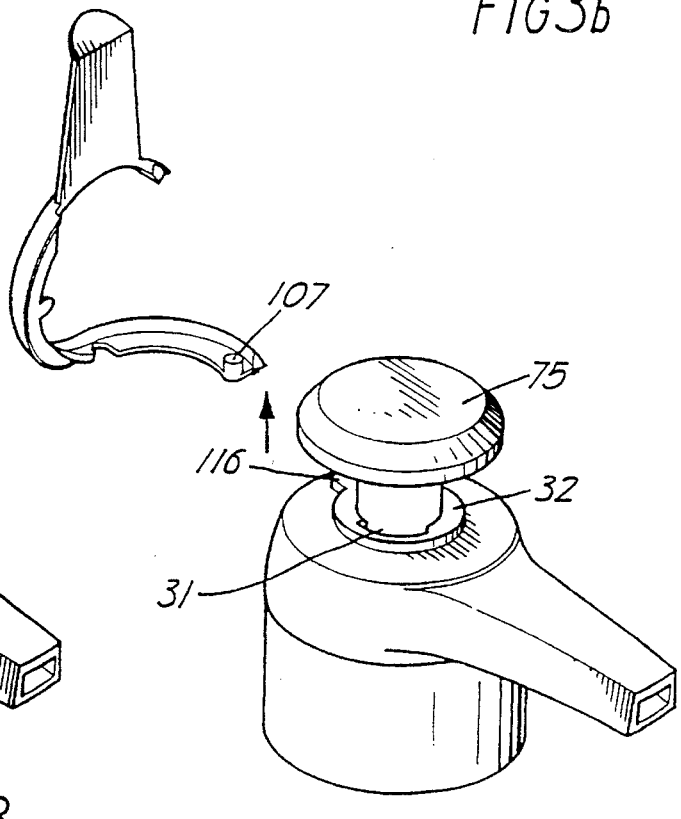

More detail is seen in FIGS. 1 and 2. Plunger stem 78 has an upper cylindrical socket 86 in which a plug 72 of the head 71 fits securely, ribs engaging the plug splines 74 to prevent relative rotation of head and stem, while a bead 73 on the plug 72 snaps into a corresponding annular groove 88 inside the stem top.

Below the socket 86, the plunger stem 78 is crossed by a wall 84 the lower surface of which is a reaction surface for the spring 90. Below the wall 84, a central nose 81 of cruciform section extends axially downwardly and concentrically with the outer tubular wall of the stem 78. This guides and retains the spring 90. At its bottom end, a central recess forms four peripheral fingers 82.

At its bottom, plunger stem 78 flares outwardly to form a sealing lip 79 which seals against the inner surface of the insert 60. A short distance above the sealing lip 79, the stem wall has a shoulder 80 for limiting upward movement of the plunger.

As seen in FIG. 1, a tamper-evident element 100 encircles the press button 75. Its detailed construction and operation are discussed later.

The parts concerned with the pumping operation are now considered in more detail.

At its bottom end, insert shell 60 comprises integrally a concentric inlet conduit and spring seat construction, with a short tubular body 62 supported in the bottom end of the cylinder 60 by integral struts 63. It has an inward flange 64, the top of which seats the pump spring 90, and the inward periphery of which forms an inlet opening through which the narrow end 83 of the plunger nose 81 extends when the plunger is down, a short distance above the inlet opening 41 of the outer shell 40 of the body, with valve 43 between.

A downward skirt of the tubular body 62 traps a one-piece valve insert 95 against an annular ridge 46 which projects up around the inlet opening 41.

The lower outer extremity of insert cylinder 60 stops short of the bottom wall of outer shell 40. The clearance is working space for a flat annular outlet flap valve 96, comprised in the valve insert 95. This insert 95 has a continuous flat outer ring forming the outlet flap valve 96 mentioned above, connected by thin flexible radial spokes 97 to a flat central valve body 43 of the inlet valve. When plunger 70 is fully locked down, its end projections 82 press the central plug 43 down to shut off the inlet.

The outlet passage starts as an annulus around the central conduit body 62, separated from the chamber inlet by the bottom skirt of the body 62, then down out through the flap valve 96 into an annular space outside the support ridge 46, and out through a front discharge recess 47 of the body shell 40 into an axial discharge channel 48.

Discharge channel 48 is defined between the outer plain cylindrical surface 65 of the insert 60 and an axially-extending recessed channel surface up the inside of the outer shell 40. Outer shell 40 has a cylindrical envelope which is concentric with the plunger axis, and the recess to form the discharge channel 48 does not interrupt the uniformity of the outer body envelope. This simplifies assembly and fitting.

The discharge channel 48 extends vertically up through the body wall, past the flange wall 12 of the securing collar 10, and to a discharge notch 49 in the wall of the shell 40 adjacent its top edge, which communicates outwardly to the discharge spout 25.

To help align the notch 49 with the discharge spout 25, body shell 40 has a forwardly projecting location fin 50 for machine assembly.

The operation of the pump itself is simple. With the plunger unlocked, the spring 90 urges it to its upward condition (FIGS. 4 and 6) priming the pump by drawing liquid into the pump chamber 38 through the inlet valve. The shoulder 80 on the outside of the plunger stem engages behind flange segments 28 around the hole 26 of the body cap 20. The predetermined position of this shoulder 80 on the moulded stem 78 sets the stroke, and hence the dose dispensed, without having to adjust the other components.

When the plunger is depressed, the pump chamber is reduced in volume, sealed by the lip 79, and drives its contents out through the outer flap 96 of the valve, through the discharge opening 47, up the discharge channel 48 and out into the discharge spout 25 to be dispensed. In this embodiment, the discharge spout 25 is substantially straight and extends radially.

Venting air enters around the stem of the plunger through the small clearance inside the stop flange segments 27 at the opening 26. See FIGS. 1 and 4. The annular space immediately below the opening 26 is generally closed off by the engagement of the top rim 66 of the body insert 60 against the underside of the body cap 20, further sealed by an annular tongue and groove 67. However at one location, opposing the discharge spout 25, a shallow radial notch 29 (see FIG. 4) allows vented air to pass the rim 66 through a vent slot 51 of the outer body shell 40. Below the vent slot 51, the body shell wall has an elongate axially-extending vent channel 52, bounded on its inner side by the outer surface of the insert 60, leading to a lower vent opening 53 out through the body shell wall. Lower-opening 53 is within the container space in use. A reduced diameter portion 149 at the bottom of the body shell 40 ensures that a container neck pushed up around the pump body 39 cannot close off the lower vent opening 53.

The body of the pump and pump chamber 38 lie substantially inside the container space. In this embodiment, the seal lip 79 scarcely rises above the level of flange wall 12 even at the limit of the up-stroke, and not above the discharge spout 25 at all. About 80% of the stroke of the seal 79 lies below the flange wall 12, which locates the top of the container neck. A very low profile pump is achieved.

Locking is now described in detail. See FIG. 2. Around the opening 26 the cap wall has two opposed inward flange segments 27, each of 90°, separated by 90° clearances 31 which admit the lugs 85 of the plunger stem. Each clearance 31 lies over a lower flange 28 which prevents over-depression of the plunger but allows the lugs 85 to drop below the flange segments 27 and rotate beneath them. Each lower flange 28 has an abutment at one end, so that this rotation can be done only in one sense, here clockwise. In this locked condition, as seen in FIG. 1, the flanges 27 hold the plunger down. In the absence of the tamper-evident element 100, the plunger can be unlocked by rotating the button 75 anticlockwise to register the lugs 85 with the clearances 31 (FIG. 5), whereupon the spring 90 pushes it up.

The locked condition of the pump includes measures against leakage. As seen in FIG. 1, the end projections 82 of the plunger stem hold the inlet valve shut. To avoid leakage through the vent, the shallow notch 29 in the cap is made sufficiently small to form an effective choke, preventing the passage of most liquids. Secondly, the plunger button 75 has a downward annular skirt 178 which fits around a circular eminence 32 to catch any liquid escaping past the choke 29 and hole 26.

Finally, the tamper-evident closure is described. A first version is seen in FIGS. 2 and 3. As mentioned, it comprises a ring 101 with a tag 102. Ring 101 is continuous, but adjacent one side of the tag has a thinner, frangible portion 103. The ring has an L-section formed by an upstanding portion 104 and by a flat retaining flange 105 which projects radially inwardly from it. Diametrically opposite the tag 102, retaining flange 105 has a notch 106. Next to the frangible portion 103, the flange 105 carries an upstanding stud 107.

The tamper-evident element 100 lies on the top wall 24 of the body cap 20. Tag 102 projects forwardly along discharge spout 25. Notch 106 in the retaining flange 105 fits over a cap lug 116 which prevents rotation of the element 100 around the cap 20. The parts are assembled with the plunger in the locked-down position, and the stud 107 projects up to engage a radial rib 179 on the underside of the push button 75. The combined engagement of notch 106 with lug 116, and stud 107 with the socket formed by rib 179, prevents any rotation of the plunger button 75 relative to the body cap 20.

After purchase, the pump can be unlocked as follows. Tag 102 may be marked e.g. with a backwardly-pointing arrow as shown in FIG. 3(*a*). The user grips and pulls in that direction. This lifts the tag 102 and breaks the frangible part 103, as shown in FIG. 3(*b*). The broken ring 101 peels back from the plunger head and retaining flange 105 pulls out from underneath. As the back side of the ring pulls clear (FIG. 3(*c*)) it disengages notch 106 from lug 116 and the button 75 can rotate relative to the cap 20. Further pulling on tag 102, to remove it, pulls on the stud 107 to rotate the button 75 anti-clockwise. After a quarter of a turn, the lugs 85 on the plunger stem register with the clearances 31 around the cap hole 26 and the plunger is driven up by the spring 90 as shown in FIG. 3(*d*).

The rising of the plunger at least partially primes the pump.

The stem 78 is not a true cylinder. The sealing lip 79 is exactly circular, but the stem 78 is slightly squared in section so that it tends towards one of four preferential rotational orientations in the hole 26. This helps to prevent the plunger from rotating in operation and hence from being stopped by stop flanges 27 instead of lower flanges 28, which would affect the dose. It is also helpful when turning the plunger using the fingers.

For tamper evidence, it is preferred to use a snap fit closure as illustrated in FIGS. 1 and 4 for the collar 10, with a smooth outer surface to make it difficult to grip. Alternatively, it is possible to use a series of projecting snap lugs which engage into corresponding snap recesses or behind an annular rib on the container neck. In machine assembly, a large axial force can force the collar 10 onto the container neck. Once assembled, however, it is extremely difficult to pull the collar off again by hand.

The collar 10 also features an inner cylindrical wall 113 projecting down from the inner periphery of the top flange wall 12, which is forced into the inside of the container neck opening to plug it, prevent leakage, and reduce any tendency for the neck to flex inwards.

The embodiment shown in FIGS. 5 and 6 uses instead a screw-threaded collar, which is easier to remove—it may be ribbed—e.g. to refill a container, but conversely may reduce tamper-evidence.

Figure 9A:
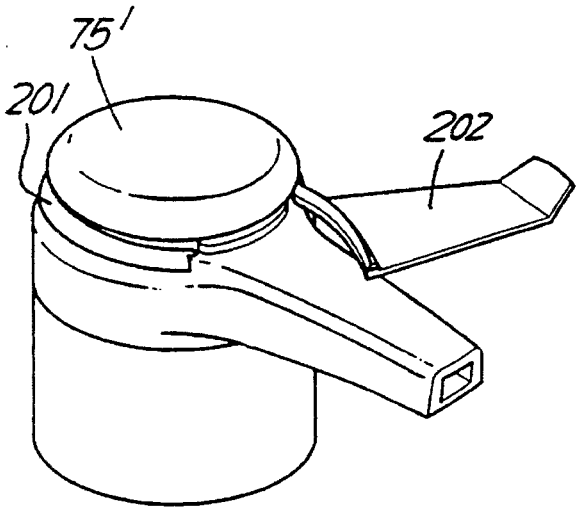
Figure 9B:
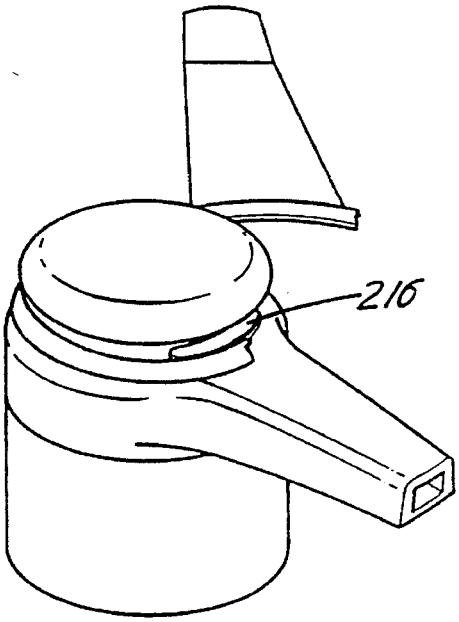

FIGS. 7 to 9 show a second version of the tamper-evident closure. As before, the tamper-evident member 200 comprises a flat ring 201 with an integral grip tag 202. A thin, breakable location 203 is provided at one side of the tag 202 and the ring 201 has an upstanding portion 204 and an inwardly projecting lower flange portion 205, for trapping under the button 75' of the plunger, having plural inward projections with upward lugs 210 for more secure retention. By the tag 202, on the side opposite the breakable part 203, the retaining flange 205 has an upward stud 207 which engages, in the locked condition, with a socket formed by a rib 276 under the button 75'. Relative rotation of the parts is prevented by engagement of an exposed end of the ring 201 at the breakable part 203 against a circumferential arcuate lug 216 projecting up from the pump cap below the root of the tag 202.

This embodiment works even if the user removes it incorrectly by unwinding rather than pulling it off. FIG. 8 shows the direct pull: the breakable link 203 ruptures, freeing the broken end 201' of the ring to move past the anti-rotation lug 216 while the stud 207 immediately starts to rotate the plunger button. The retaining flange 205 prevents complete escape of the element 200 until after a quarter turn, when the plunger can rise. FIG. 9 shows that, even when the user breaks the ring and then "unwinds" the tag 202, the plunger will still be rotated through the necessary quarter turn because the stud 207 is close to the root of the tag 202.

The various pump parts described may for the most part be made from injection-moulded plastics material e.g. polyolefin. The plunger button 75 is usefully made from a harder plastics than the sealing lip 79.

In the embodiments described, it is desirable to prevent relative rotation of certain pump parts. Such rotation is conveniently prevented by providing notches on one part with keys to engage them.

The discharge nozzle has been described in the form of a spout 25. However other forms are possible. Usually the nozzle will initially project radially, although this need not always be so. It may be a curved spout, a straight spout, or a simple opening without a spout projecting. Or, it may be a spray nozzle. The term "nozzle" is intended to cover these possibilities.

Pumps embodying the invention may be suitable for small dispensed doses, preferably less than 10 ml and most preferably less than 5 ml.

I claim:

1. A dispenser pump having:

a pump body defining a pump chamber, with means for mounting the pump body on the neck of a container with a first end of the pump body directed away from and a second end towards the container, the pump body comprising an outer shell and an inner shell nested together, the inner shell's outer surface fitting against the outer shell's inner surface along the pump body;

a reciprocable plunger extending axially from the first end of the pump body into the pump chamber and operable to alter the pump chamber volume to pump material in use through a valved inlet and out through a valved outlet opening of the pump chamber, exiting the inner shell of the pump body, to a discharge opening exiting the outer shell of the pump body;

the discharge opening being on the pump body nearer the first end thereof than is the outlet opening; and a circumferentially-localized, axially-extending channel recess defined in at least one of the inner surface of the outer shell and the outer surface of the inner shell to interrupt the fit of said surfaces and thereby define between the nested inner and outer shells a circumferentially-localized axially-extending discharge passage extending in the pump body alongside the pump chamber and connecting the outlet opening to the discharge opening.

2. A dispenser pump according to claim 1 in which the pump chamber outlet opening is at or adjacent the second end of the pump chamber.

3. A dispenser pump according to claim 1 in which the mounting means for the pump body define an axial limiting location for a container neck edge relative thereto, and this limiting location lies axially between the pump chamber outlet opening and the discharge opening, and nearer to the discharge opening than to the outlet opening.

4. A dispenser pump according to claim 1 in which that end of the plunger in the pump chamber is axially between the discharge opening and the second end of the pump body over at least 40% of the plunger stroke length.

5. A container having a dispenser pump according to claim 1 mounted on a neck thereof.

6. A dispenser pump according to claim 1 in which the channel recess is defined in only one of the inner surface of the outer shell and the outer surface of the inner shell, the other said surface being plain where it defines the discharge channel.

7. A dispenser pump according to claim 1 in which the pump chamber is cylindrical, and the inner and outer surfaces of both the inner and outer shells are all cylindrical.

8. A dispenser pump according to claim 1 in which the inlet and outlet openings are adjacent one another and the dispenser pump comprises a single one-piece valve body providing said valving of the inlet and outlet openings.

9. A dispenser pump according to claim 1 in which a circumferentially-localized air vent passage is defined between the inner and outer shells, extending axially between the first end of the pump body and a lower vent opening defined through the outer shell.

10. A dispenser pump according to claim 1 in which both the inlet and outlet openings are defined through the inner shell at the second end, the inlet opening being central and the outlet opening being peripheral, the inner shell comprising a tubular inlet conduit body inside its second end to separate the inlet and outlet openings from one another.

11. A dispenser pump according to claim 10 comprising a one-piece flat annular valve body trapped between the outer shell and the tubular inlet conduit body at the second end of the inner shell, the valve body having a central movable plug portion to provide said valving of the inlet opening and a peripheral movable ring portion to provide said valving of the outlet opening, the inlet and outlet openings being in axial register with one another.

12. A plunger-operated dispenser pump having a pump body and a plunger which is reciprocable relative to the pump body to alter the volume of a pump chamber of the pump having a valved inlet and an outlet;

the pump having a locked condition in which the plunger is secured against reciprocation relative to the pump body and an unlocked condition in which the plunger is free to reciprocate, change from the locked condition to the unlocked condition being effected by a relative rotational movement, about the plunger axis, between the plunger and the pump body;

the pump further comprising a tamper-evident element engaging rotationally between the plunger and pump body to maintain them in the locked condition, and which is irreversibly breakable and removable; and wherein said engagement of the tamper-evident element is radially spaced from the plunger axis and rotationally directed whereby in a release movement, in which the tamper-evident element is broken and removed, the tamper-evident element rotates the plunger and pump body relatively from the locked condition to the unlocked condition.

13. A dispenser pump according to claim 12 in which, in the locked condition, a head of the plunger is depressed against the pump body and held so by engagement of detents thereon below corresponding detents of the pump body.

14. A dispenser pump according to claim 12 in which less than half a turn moves the plunger from the locked to the unlocked position.

15. A dispenser pump according to claim 12 in which an off-axis detent engagement of the tamper-evident element with the plunger rotates the plunger during the release movement.

16. A container having a dispenser pump according to claim 12 mounted on a neck thereof.

17. A dispenser pump according to claim 12 in which the tamper-evident element comprises a breakable ring portion around the plunger and a grip tag portion attached to the ring portion.

18. A dispenser pump according to claim 17 in which the ring portion has an inward projection trapped between the head of the plunger and the pump body.

19. A dispenser pump according to claim 18 in which an upward projection on the inward projection engages rotationally beneath the plunger head.

20. A dispenser pump according to claim 19 in which plural upward lugs are distributed around the ring portion on the inward projection, retaining the inward projection under a downwardly-extending periphery of a button of the plunger head in the locked condition.

* * * * *